US011205870B2

(12) United States Patent
Matsuo et al.

(10) Patent No.: US 11,205,870 B2
(45) Date of Patent: Dec. 21, 2021

(54) CONNECTOR TO BE CONNECTED TO A FLEXIBLE CONDUCTOR

(71) Applicant: Japan Aviation Electronics Industry, Limited, Tokyo (JP)

(72) Inventors: Seiya Matsuo, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/893,686

(22) Filed: Jun. 5, 2020

(65) Prior Publication Data

US 2021/0075146 A1 Mar. 11, 2021

(30) Foreign Application Priority Data

Sep. 9, 2019 (JP) ..... JP2019-163928

(51) Int. Cl.

| | |
|---|---|
| ***H01R 13/46*** | (2006.01) |
| ***H01R 13/502*** | (2006.01) |
| ***H01R 24/28*** | (2011.01) |
| ***H01R 24/20*** | (2011.01) |

(52) U.S. Cl.

CPC ..... *H01R 13/5025* (2013.01); *H01R 24/20* (2013.01); *H01R 24/28* (2013.01)

(58) Field of Classification Search

CPC ... H01R 4/42; H01R 4/20; H01R 4/28; H01R 13/5025; H01R 13/502; H01R 13/46

USPC ..... 439/445

See application file for complete search history.

(56) References Cited

U.S. PATENT DOCUMENTS

| | | | | |
|---|---|---|---|---|
| 7,841,861 | B2 * | 11/2010 | Jung | G11B 17/0282 439/65 |
| 10,084,276 | B2 * | 9/2018 | Matsuo | H01R 33/965 |
| 10,199,770 | B2 * | 2/2019 | Komoto | H01R 13/74 |
| 10,886,650 | B1 * | 1/2021 | Komoto | H01R 12/778 |
| 10,923,855 | B2 * | 2/2021 | Matsuo | H01R 13/642 |
| 2005/0090153 | A1 * | 4/2005 | Brochu | H01R 27/02 439/677 |
| 2014/0213074 | A1 * | 7/2014 | Tsang | H01R 13/5213 439/37 |
| 2015/0296935 | A1 * | 10/2015 | Rana | A44C 5/0007 63/3 |

(Continued)

FOREIGN PATENT DOCUMENTS

JP 2018-129244 A 8/2018

*Primary Examiner* — Harshad C Patel

(74) *Attorney, Agent, or Firm* — Muncy, Geissler, Olds & Lowe, P.C.

(57) ABSTRACT

A connector includes a first insulator, a second insulator and a contact connected to the flexible conductor, the flexible conductor having an internal conductive portion and an external conductive portion, a sheet-like member being sandwiched between the circumferential edges of the first insulator and the second insulator while overlapping the flexible conductor to attach the connector to the sheet-like member, the first insulator positioned on a side of the flexible conductor in a position where the sheet-like member and the flexible conductor overlap each other having a cutout formed to correspond to the flexible conductor, a part of the external conductive portion adjacent to the internal conductive portion of the flexible conductor entering the cutout when the sheet-like member is bent at an edge of the first insulator together with the flexible conductor.

13 Claims, 9 Drawing Sheets

(56) References Cited

U.S. PATENT DOCUMENTS

2018/0233854 A1* 8/2018 Komoto ..... H01R 13/629
2020/0022425 A1* 1/2020 Hashiguchi ..... H01R 4/58

* cited by examiner

CONNECTOR TO BE CONNECTED TO A FLEXIBLE CONDUCTOR

BACKGROUND OF THE INVENTION

The present invention relates to a connector, particularly to a connector to be connected to a flexible conductor.

As the connector to be connected to a flexible conductor, for example, JP 2018-129244 A discloses a connector 1 as illustrated in FIG. 27. The connector 1 includes a housing 3 and a base member 4 that are disposed on the opposite sides across a flexible substrate 2 to sandwich the flexible substrate 2 therebetween. A flexible conductor 5 is exposed on the front surface of the flexible substrate 2, a contact 6 disposed on the flexible conductor 5 has a projection accommodating portion 7 of a recess shape, and a projection 8 is formed on the base member 4 to project toward the rear surface of the flexible substrate 2.

When the projection 8 of the base member 4 is, together with the flexible substrate 2, inserted into the projection accommodating portion 7 of the contact 6 with the flexible substrate 2 being sandwiched between the projection 8 and the contact 6 such that the projection 8 is covered with the flexible substrate 2, the flexible substrate 2 is pressed against the inner surface of the projection accommodating portion 7 of the contact 6 by the projection 8, and the inner surface of the projection accommodating portion 7 makes contact with the flexible conductor 5 exposed on the front surface of the flexible substrate 2 accordingly, whereby the contact 6 is electrically connected to the flexible conductor 5.

When the flexible conductor 5 of the flexible substrate 2 to which the connector 1 is connected as above extends to the outside of the housing 3 and the base member 4 and is connected to a garment-side wire disposed on, for example, cloth of a garment, the connector 1 can be used as a garment-side connector portion for fitting a so-called wearable device.

However, the garment to which the connector 1 as above is attached would be, for example, rubbed together with the connector 1 in water when the garment is washed, and folded while the connector 1 remains attached thereto when the garment is stored and kept. Therefore, the flexible conductor 5 of the flexible substrate 2 extending to the outside of the housing 3 and the base member 4 would be bent at edges of the housing 3 and the base member 4 which have rigidity, and bending stress would be concentrated on this part of the flexible conductor 5, which may cause breaking thereof, disadvantageously.

SUMMARY OF THE INVENTION

The present invention has been made to solve the conventional problem described above and aims at providing a connector capable of relaxing concentration of bending stress acting on a flexible conductor and preventing disconnection of the flexible conductor.

A connector according to the present invention is a connector to be connected to a flexible conductor, the connector comprising:

a first insulator;

a second insulator disposed to face the first insulator; and a contact made of a conductive material and connected to the flexible conductor, wherein the flexible conductor includes an internal conductive portion that is sandwiched between the first insulator and the second insulator and is electrically connected to the contact, and an external conductive portion that extends to the an outside of the first insulator and the second insulator, wherein a sheet-like member extending at least from a circumferential edge of the first insulator and a circumferential edge of the second insulator to an the outside of the first insulator and the second insulator is sandwiched between the circumferential edge of the first insulator and the circumferential edge of the second insulator while overlapping the flexible conductor, whereby the connector is attached to the sheet-like member, wherein of the first insulator and the second insulator, the first insulator positioned on a side of the flexible conductor in a position where the sheet-like member and the flexible conductor overlap each other has a cutout formed to correspond to the flexible conductor, and wherein when the sheet-like member is bent at an edge of the first insulator together with the flexible conductor together with the flexible conductor, a part of the external conductive portion adjacent to the internal conductive portion of the flexible conductor enters the cutout.

DETAILED DESCRIPTION OF THE INVENTION

Embodiments of the present invention are described below with reference to the accompanying drawings.

Embodiment 1

Figure 1:
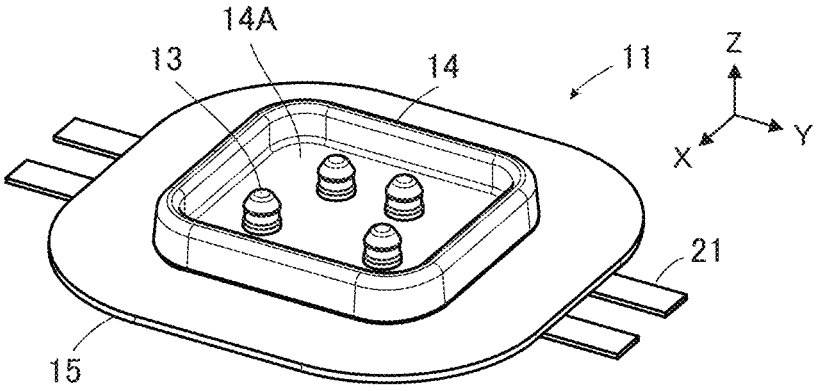
FIG. 1 is a perspective view showing a connector according to Embodiment 1 of the present invention when viewed from an obliquely upper position.
Figure 2:
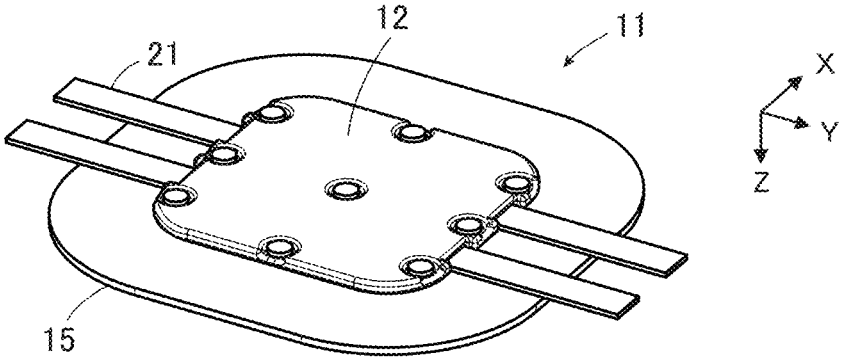
FIG. 2 is a perspective view showing the connector according to Embodiment 1 when viewed from an obliquely lower position.

FIGS. 1 and 2 illustrate a connector 11 according to Embodiment 1. The connector 11 is used as, for example, a garment-side connector portion for fitting a wearable device and is connected to a plurality of flexible conductors 21.

The connector 11 includes a first insulator 12, a plurality of contacts 13 and a second insulator 14 that faces the first insulator 12 with the plurality of flexible conductors 21 being sandwiched therebetween, and the plurality of contacts 13 are electrically connected to the plurality of flexible conductors 21. The second insulator 14 includes a recess portion 14A, and in the recess portion 14A of the second insulator 14, the contacts 13 project perpendicularly to a flat bottom surface of the recess portion 14A.

The connector 11 further includes a sheet-like member 15 disposed between the second insulator 14 and the flexible conductors 21. The sheet-like member 15 is made of insulating resin or cloth and extends to the outside of the first insulator 12 and the second insulator 14 so as to seamlessly surround the outer peripheries of the first insulator 12 and the second insulator 14.

The flexible conductors 21 are conductive members produced by processing conductive fibers into a strip shape and have conductivity and flexibility. The flexible conductors 21 are arranged to extend in parallel to each other.

For convenience, the bottom surface of the recess portion 14A of the second insulator 14 is defined as extending along an XY plane, the direction in which the flexible conductors 21 each extend is referred to as "Y direction," and the direction in which the contacts 13 each project is referred to as "+Z direction."

Figure 3:
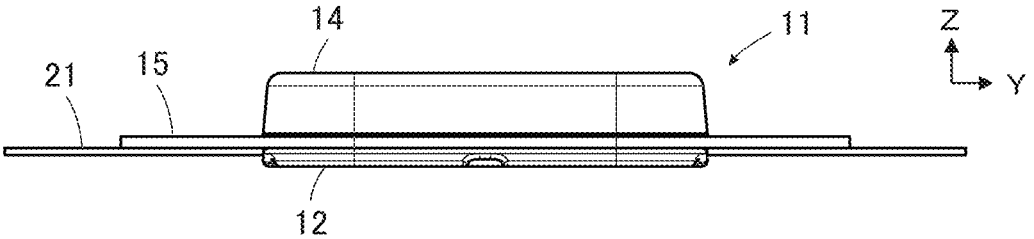
FIG. 3 is a side view showing the connector according to Embodiment 1.

As illustrated in FIG. 3, the flexible conductors 21 are disposed on the +Z direction side of the first insulator 12, the sheet-like member 15 is disposed on the +Z direction side of the flexible conductors 21, and the second insulator 14 is disposed on the +Z direction side of the sheet-like member 15.

Figure 4:
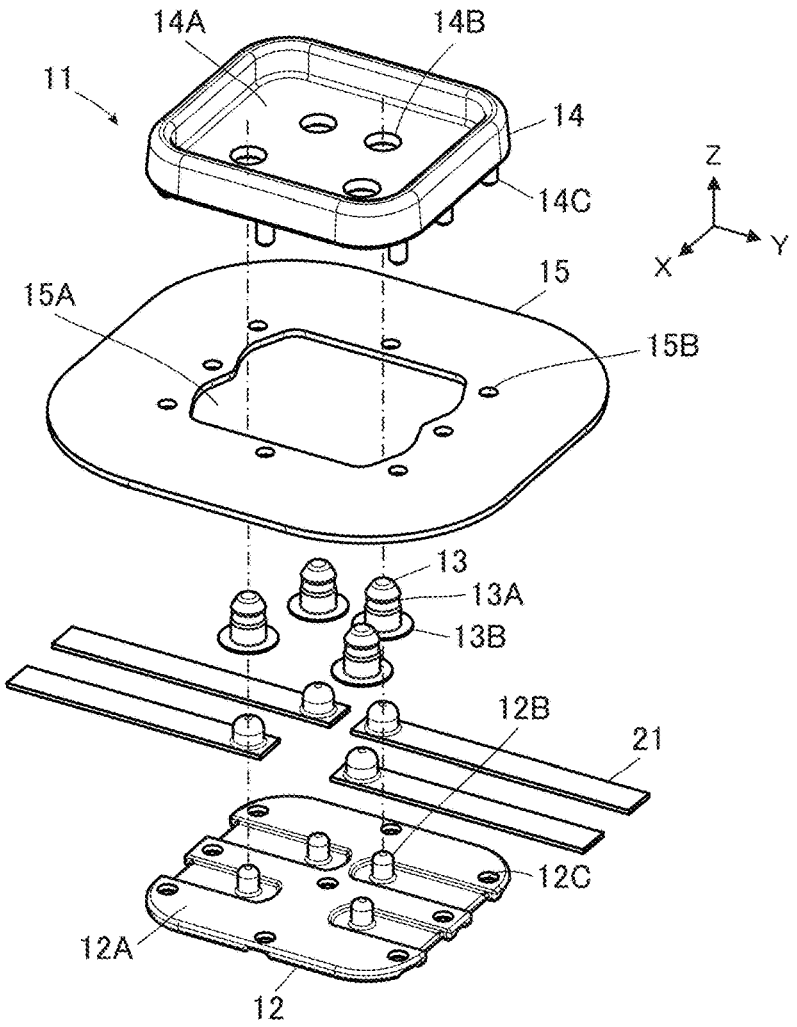
FIG. 4 is an exploded perspective view showing the connector according to Embodiment 1.

As illustrated in FIG. 4, the second insulator 14 has a plurality of contact through-holes 14B formed in the recess portion 14A opening in the +Z direction. The recess portion 14A constitutes a counter-connector accommodating portion in which a part of a counter connector (not shown) is to be accommodated, and the contact through-holes 14B separately correspond to the contacts 13. On a surface of the second insulator 14 facing in the −Z direction, a plurality of bosses 14C are formed to project in the −Z direction.

The sheet-like member 15 constitutes a connector fixing member for attaching the connector 11 to a garment (not shown), and the connector 11 is attached to the garment by fixing the sheet-like member 15 to cloth of the garment.

The sheet-like member 15 is provided at the center thereof with an opening portion 15A, and a plurality of through-holes 15B separately corresponding to the plurality of bosses 14C of the second insulator 14 are arranged along the periphery of the opening portion 15A.

The contacts 13 are plug-type contacts made of a conductive material such as metal, and are to be connected to corresponding contacts of a counter connector (not shown) when a part of the counter connector is accommodated in the recess portion 14A of the second insulator 14. Each contact 13 has a tubular portion 13A of a cylindrical shape extending in the Z direction and a flange 13B extending from the −Z directional end of the tubular portion 13A along an XY plane.

The first insulator 12 has a flat plate portion 12A, and on the flat plate portion 12A, a plurality of projections 12B are formed to project therefrom in the +Z direction. The projections 12B separately correspond to the contacts 13. Further, the flat plate portion 12A is provided with a plurality of boss accommodating holes 12C separately corresponding to the plurality of bosses 14C of the second insulator 14.

The contact through-holes 14B of the second insulator 14, the contacts 13, the flexible conductors 21 and the projections 12B of the first insulator 12 are arranged so as to align with each other in the Z direction.

Similarly, the bosses 14C of the second insulator 14, the through-holes 15B of the sheet-like member 15 and the boss accommodating holes 12C of the first insulator 12 are arranged so as to align with each other in the Z direction.

The contact through-holes 14B of the second insulator 14 have an inside diameter larger than the outside diameter of the tubular portions 13A of the contacts 13 and smaller than the outside diameter of the flanges 13B to allow smooth insertion of the tubular portions 13A of the contacts 13.

The through-holes 15B of the sheet-like member 15 have an inside diameter slightly larger than the outside diameter of the bosses 14C of the second insulator 14 to allow smooth insertion of the bosses 14C of the second insulator 14.

The boss accommodating holes 12C of the first insulator 12 have an inside diameter equal to or slightly smaller than the outside diameter of the bosses 14C of the second insulator 14, and by inserting the bosses 14C into the boss accommodating holes 12C, the first insulator 12 and the second insulator 14 are fixed to each other.

Figure 5:
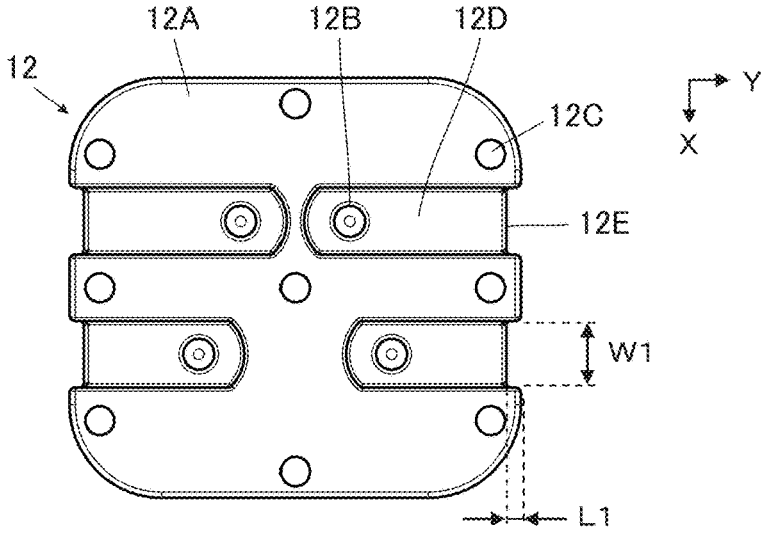
FIG. 5 is a plan view showing a first insulator used in the connector according to Embodiment 1.

As illustrated in FIG. 5, a plurality of conductor accommodating grooves 12D are formed in the flat plate portion 12A of the first insulator 12 to separately correspond to the plurality of projections 12B. The conductor accommodating grooves 12D extend in the Y direction. Of the opposite end portions of each conductor accommodating grooves 12D in the Y direction, one end portion positioned on the center side of the flat plate portion 12A is provided with the corresponding projection 12B projecting therefrom, while the other end portion thereof opens at the corresponding part of the edge of the flat plate portion 12A. Further, the edge of the flat plate portion 12A is provided with a plurality of cutouts 12E each connected to the opening end portion of the corresponding conductor accommodating groove 12D.

The conductor accommodating groove 12D is configured to accommodate the corresponding flexible conductor 21, and has a width W1 slightly wider than that of the flexible conductor 21 in the X direction and a depth approximately equal to the thickness dimension of the flexible conductor 21 in the Z direction.

The cutout 12E is configured to receive a part of the corresponding flexible conductor 21 when the flexible conductor 21 is bent together with the sheet-like member 15, and has the width W1 same as that of the conductor accommodating groove 12D in the X direction and a predetermined length L1 in the Y direction. More specifically, the presence of the cutout 12E allows the opening end portion of the conductor accommodating groove 12D to be disposed at a position retreated by the length L1 in the Y direction from the position of the edge of the flat plate portion 12A where the conductor accommodating groove 12D is not formed, toward the inside of the flat plate portion 12A.

Figure 6:
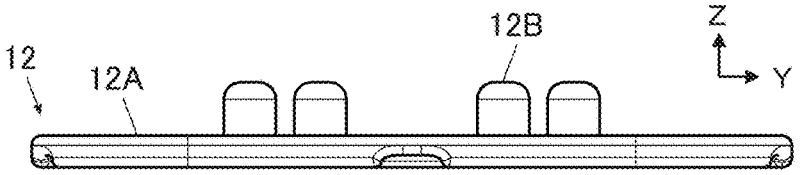
FIG. 6 is a side view showing the first insulator used in the connector according to Embodiment 1.

As illustrated in FIG. 6, the projections 12B of the first insulator 12 each have a substantially columnar shape projecting in the +Z direction.

Figure 7:
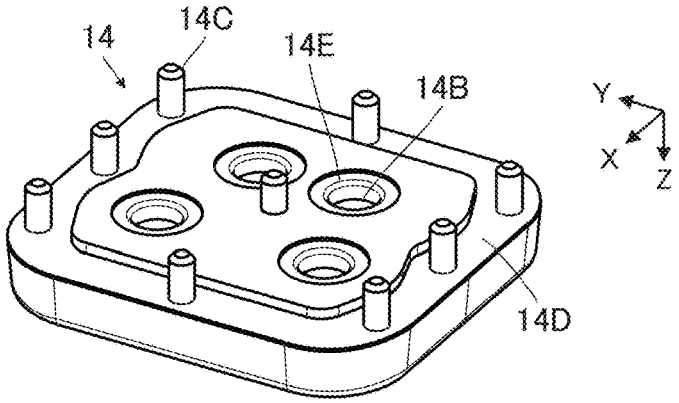
FIG. 7 is a perspective view showing a second insulator used in the connector according to Embodiment 1 when viewed from an obliquely lower position.

As illustrated in FIG. 7, a step portion 14D depressed and surrounding the contact through-holes 14B is formed on the circumferential edge of the surface of the second insulator 14 facing in the −Z direction. The step portion 14D is configured to accommodate the circumferential edge of the opening portion 15A of the sheet-like member 15 and has a depth approximately equal to the thickness dimension of the sheet-like member 15.

An annular flange accommodating groove 14E is formed to surround each of the contact through-holes 14B. The annular flange accommodating groove 14E is configured to accommodate the flange 13B of the corresponding contact 13 and has a depth approximately equal to the thickness dimension of the flange 13B.

Figure 8:
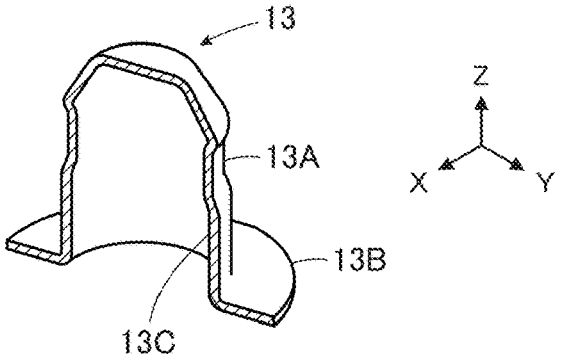
FIG. 8 is a cross-sectional perspective view showing a contact used in the connector according to Embodiment 1.

As illustrated in FIG. 8, the tubular portion 13A of the contact 13 has a cylindrical shape with its +Z directional end being closed, the flange 13B is formed integrally with the −Z directional end of the tubular portion 13A, and a projection accommodating portion 13C of a recess shape is formed in the tubular portion 13A. More specifically, the flange 13B is formed so as to surround an opening end of the projection accommodating portion 13C.

The contact 13 as above can be manufactured by, for example, press working, cutting or cold heading.

When the connector 11 is connected to the plurality of flexible conductors 21, first, the plurality of bosses 14C of the second insulator 14 are separately inserted into the plurality of through-holes 15B of the sheet-like member 15. At this time, the plurality of contact through-holes 14B of the second insulator 14 are positioned in the opening portion 15A of the sheet-like member 15.

Subsequently, the tubular portion 13A of each of the contacts 13 is inserted from the −Z direction into the corresponding one of the plurality of contact through-holes 14B of the second insulator 14, and the first insulator 12 is pressed against the second insulator 14 in the +Z direction with the plurality of flexible conductors 21 being sandwiched therebetween. Consequently, each of the plurality of projections 12B of the first insulator 12 is inserted into the projection accommodating portion 13C of the corresponding contact 13 together with the corresponding flexible conductor 21.

In addition, by pressing the first insulator 12 against the second insulator 14, the plurality of bosses 14C of the second insulator 14 are press-fitted into the plurality of boss accommodating holes 12C of the first insulator 12 to fix the second insulator 14 and the first insulator 12 to each other, and thus the connection process for connecting the connector 11 to the plurality of flexible conductors 21 is completed.

Figure 9:
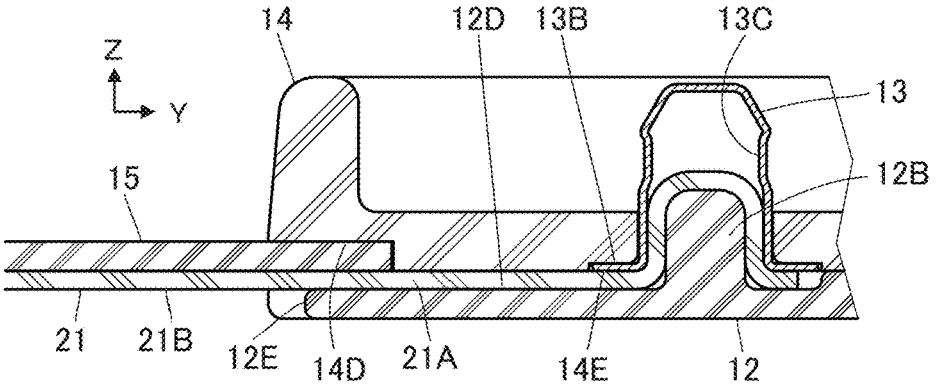
FIG. 9 is a partial cross-sectional view showing the connector according to Embodiment 1.

When the projection 12B of the first insulator 12 is inserted into the projection accommodating portion 13C of the contact 13 together with the flexible conductor 21 as above, as illustrated in FIG. 9, the flexible conductor 21 is sandwiched between a lateral surface of the projection 12B and an inner surface of the projection accommodating portion 13C of the contact 13, and the flexible conductor 21 contacts the inner surface of the projection accommodating portion 13C, whereby the contact 13 is electrically connected to the flexible conductor 21.

Of each of the flexible conductors 21, a part sandwiched between the first insulator 12 and the second insulator 14 and electrically connected to the contact 13 is called an internal conductive portion 21A, and a part extending to the outside of the first insulator 12 and the second insulator 14 is called an external conductive portion 21B.

At this time, the circumferential edge of the opening portion 15A of the sheet-like member 15 is accommodated in the step portion 14D of the second insulator 14, the flange 13B of the contact 13 is accommodated in the annular flange accommodating groove 14E of the second insulator 14, and the internal conductive portion 21A of the flexible conductor 21 is accommodated in the conductor accommodating groove 12D of the first insulator 12. Consequently, a surface of the flat plate portion 12A of the first insulator 12 facing in the +Z direction and the surface of the second insulator 14 facing in the −Z direction are brought into contact with each other. Therefore, the connector 11 having excellent waterproof properties can be formed by bonding, using for example an adhesive, the first insulator 12 and the second insulator 14 to each other with the internal conductive portions 21A of the plurality of flexible conductors 21 being sandwiched therebetween, and thereby forming a waterproof layer made of the solidified adhesive between the first insulator 12 and the second insulator 14.

Figure 10:
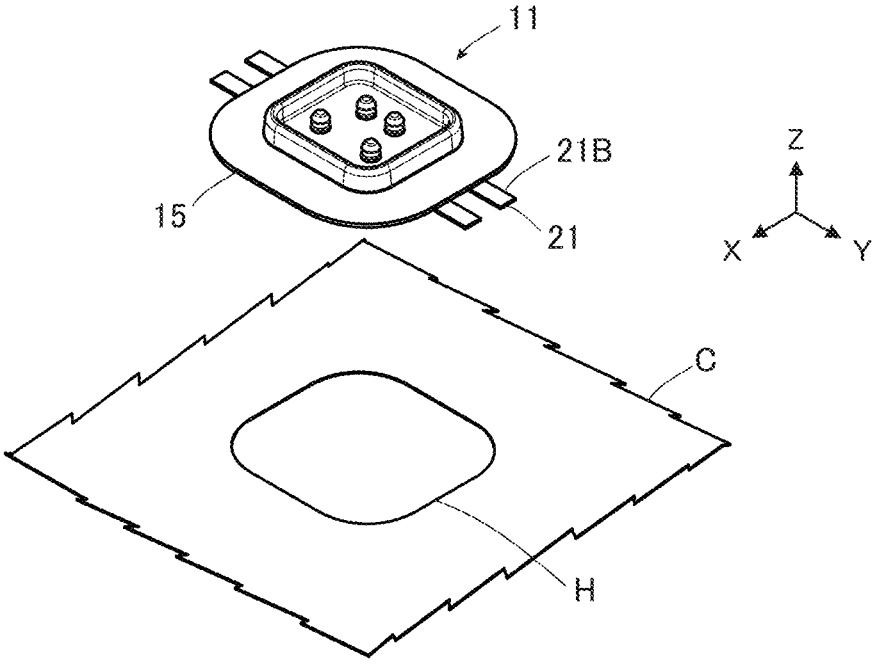
FIG. 10 is a perspective view showing how the connector according to Embodiment 1 is attached to cloth of a garment.

As illustrated in FIG. 10, the connector 11 can be attached to cloth C of a garment. The cloth C is provided with an opening portion H smaller than the sheet-like member 15, and the connector 11 is disposed on the front surface side (+Z direction side) of the cloth C such that the opening portion H is covered with the sheet-like member 15. The connector 11 is attached to the garment by sewing the circumferential edge of the sheet-like member 15 to the cloth C using, for example, an insulating thread.

The external conductive portions 21B of the flexible conductors 21 to which the connector 11 is connected are passed to the rear surface side (−Z direction side) of the cloth C through the opening portion H and are connected to garment-side wires (not shown) disposed on the rear surface of the cloth C.

Figure 11:
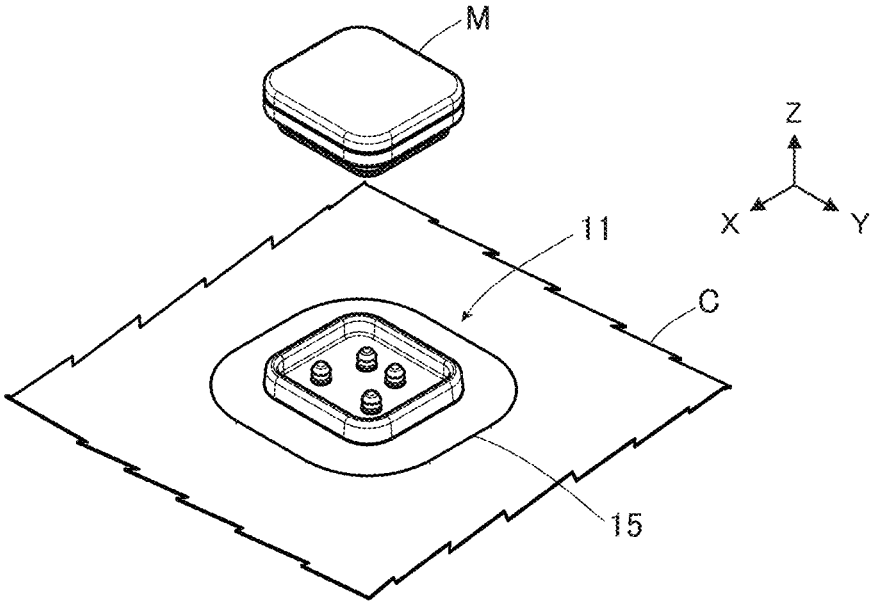
FIG. 11 is a perspective view showing how a wearable device is fitted with the connector according to Embodiment 1 attached to the cloth of the garment.

Consequently, as illustrated in FIG. 11, the connector 11 functions as a garment-side connector portion for fitting a wearable device M as a counter connector.

Figure 12:
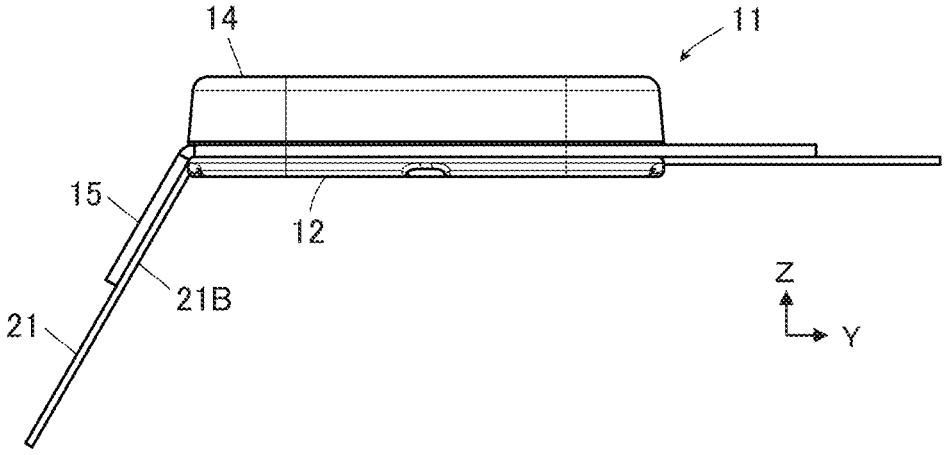
FIG. 12 is a side view showing the connector according to Embodiment 1 in a state where a sheet-like member is bent at an edge of the first insulator together with a flexible conductor.

The garment to which the connector 11 is attached as above would be rubbed together with the connector 11 in water when the garment is washed, and folded while the connector 11 remains attached thereto when the garment is stored and kept. Therefore, for example, as illustrated in FIG. 12, the sheet-like member 15 and the external conductive portion 21B of the flexible conductor 21, both of which extend to the outside of the first insulator 12 and the second insulator 14, may be bent at the edges of the first insulator 12 and the second insulator 14 which have rigidity.

However, as illustrated in FIG. 5, the cutouts 12E connected to the opening end portions of the conductor accommodating grooves 12D are formed at the edge of the flat plate portion 12A of the first insulator 12, and the opening end portions of the conductor accommodating grooves 12D are each disposed at the position retreated by the length L1 in the Y direction from the position of the edge of the flat plate portion 12A where the conductor accommodating groove 12D is not formed, toward the inside of the flat plate portion 12A.

The internal conductive portions 21A of the flexible conductors 21 are accommodated in the conductor accommodating grooves 12D of the first insulator 12, on the other hand, the sheet-like member 15 extends to the outside of the first insulator 12 and the second insulator 14 while seamlessly surrounding the outer peripheries of the first insulator 12 and the second insulator 14.

Figure 13:
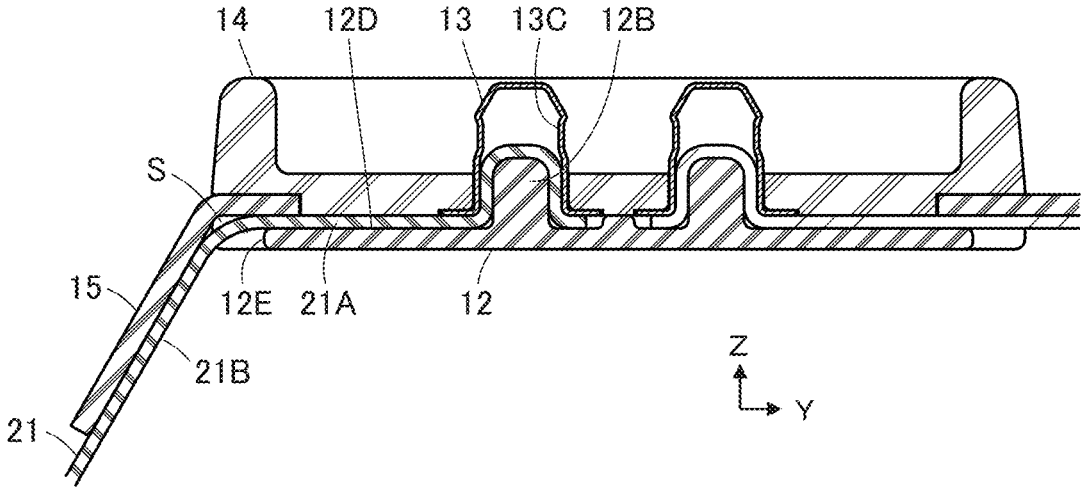
FIG. 13 is a partial cross-sectional view showing the connector of Embodiment 1 in the state illustrated in FIG. 12.

Therefore, for example, as illustrated in FIG. 13, even when the sheet-like member 15 is bent at the edge of the first insulator 12 in the −Z direction, a part of the external conductive portion 21B adjacent to the internal conductive portion 21A of the flexible conductor 21 enters the cutout 12E connected to the opening end portion of the conductor accommodating groove 12D of the first insulator 12, whereby the flexible conductor 21 is allowed to extend along the sheet-like member 15 in the −Z direction while being gently curved with a relatively large radius of curvature without sharply bending at the opening end portion of the conductor accommodating groove 12D.

As a result, a gap S is formed between the bending portion of the sheet-like member 15 and the external conductive portion 21B of the flexible conductor 21 that is gently curved.

Thus, concentration of bending stress acting on the flexible conductor 21 is relaxed, whereby disconnection of the flexible conductor 21 can be prevented even when the connector is used while remaining attached to a garment for a long time.

In order for the flexible conductor 21 to be gently curved at the cutout 12E of the first insulator 12, the Y directional length L1 of the cutout 12E is preferably longer than, for example, the thickness dimension of the flexible conductor 21.

While the conductor accommodating groove 12D and the cutout 12E of the first insulator 12 have the width W1 slightly wider than that of the flexible conductor 21 in the X direction, the invention is not limited thereto, and they may have a width equal to that of the flexible conductor 21.

Embodiment 2

While the connector 11 is connected to the plurality of flexible conductors 21 each processed into a strip shape in Embodiment 1, the invention is not limited thereto.

Figure 14:
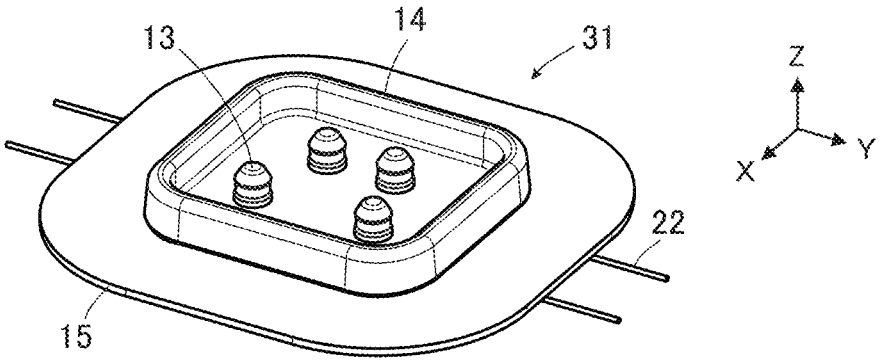
FIG. 14 is a perspective view showing a connector according to Embodiment 2 when viewed from obliquely upper position.
Figure 15:
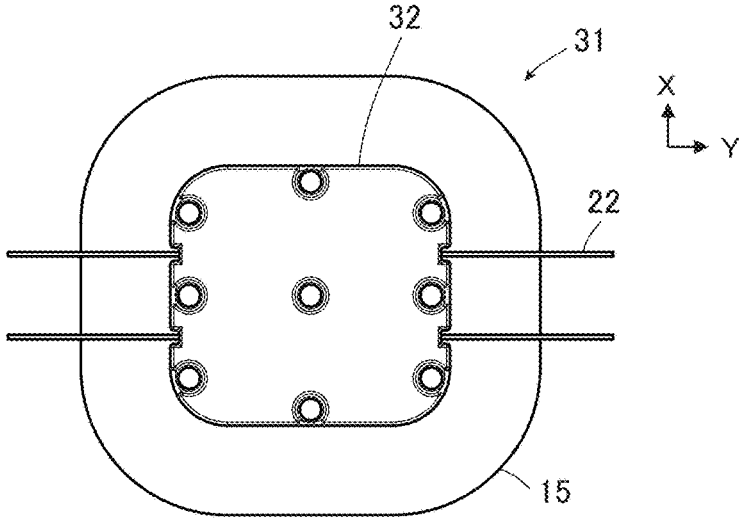
FIG. 15 is a bottom view showing the connector according to Embodiment 2.

FIGS. 14 and 15 illustrate a connector 31 according to Embodiment 2. The connector 31 is a connector connected to a plurality of flexible conductors 22 each processed into a thread-like shape by twisting a plurality of conductive fibers. The connector 31 is the same as the connector 11 according to Embodiment 1 except that a first insulator 32 is used instead of the first insulator 12 in the connector 11 according to Embodiment 1.

More specifically, the connector 31 includes the first insulator 32, the plurality of contacts 13, the second insulator that faces the first insulator 32 with the plurality of flexible conductors 22 being sandwiched therebetween, and the sheet-like member 15 disposed between the second insulator 14 and the plurality of the flexible conductors 22.

Figure 16:
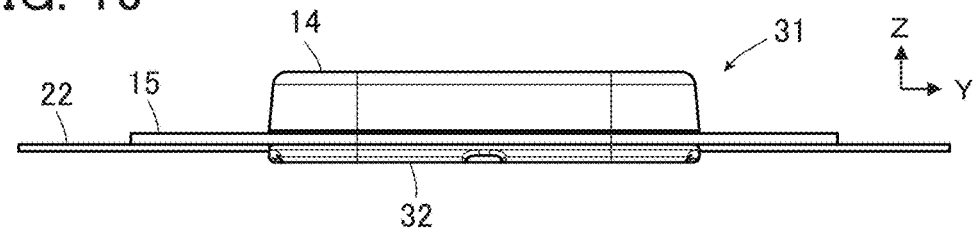
FIG. 16 is a side view showing the connector according to Embodiment 2.

As illustrated in FIG. 16, the flexible conductors 22 are disposed on the +Z direction side of the first insulator 32, the sheet-like member 15 is disposed on the +Z direction side of the flexible conductors 22, and the second insulator 14 is disposed on the +Z direction side of the sheet-like member 15.

Figure 17:
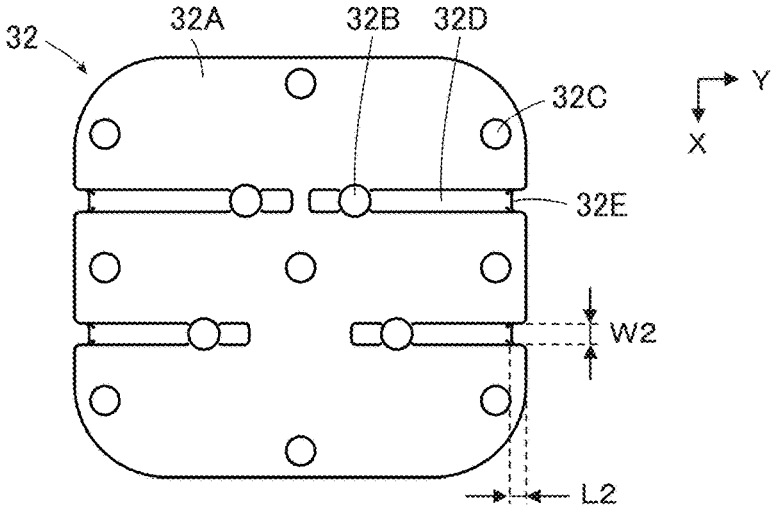
FIG. 17 is a plan view showing a first insulator used in the connector according to Embodiment 2.

As illustrated in FIG. 17, the first insulator 32 has a flat plate portion 32A, and on the flat plate portion 32A, a plurality of projections 32B separately corresponding to the plurality of contacts 13 are formed to project therefrom in the +Z direction, and a plurality of conductor accommodating grooves 32D are formed to separately correspond to the plurality of projections 32B. The conductor accommodating grooves 32D extend in the Y direction. Of the opposite end portions of each conductor accommodating groove 32D in the Y direction, one end portion positioned on the center side of the flat plate portion 32A is provided with the corresponding projection 32B projecting therefrom, while the other end portion thereof opens at the corresponding part of the edge of the flat plate portion 32A. Further, the edge of the flat plate portion 32A is provided with a plurality of cutouts 32E each connected to the opening end portion of the corresponding conductor accommodating groove 32D.

The conductor accommodating groove 32D is configured to accommodate the corresponding flexible conductor 22, and has a width W2 slightly wider than the diameter dimension of the flexible conductor 22 in the X direction and a depth approximately equal to the diameter dimension of the flexible conductor 22 in the Z direction.

The cutout 32E is configured to accommodate the corresponding flexible conductor 22 when the flexible conductor 22 is bent together with the sheet-like member 15, and has the width W2 same as that of the conductor accommodating groove 32D in the X direction and a predetermined length L2 in the Y direction. More specifically, the presence of the cutout 32E allows the opening end portion of the conductor accommodating groove 32D to be disposed at a position retreated by the length L2 in the Y direction from the position of the edge of the flat plate 32A where the conductor accommodating groove 32D is not formed, toward the inside of the flat plate portion 32A.

In addition, a plurality of boss accommodating holes 32C corresponding to the plurality of bosses 14C of the second insulator 14 are formed in the flat plate portion 32A.

Figure 18:
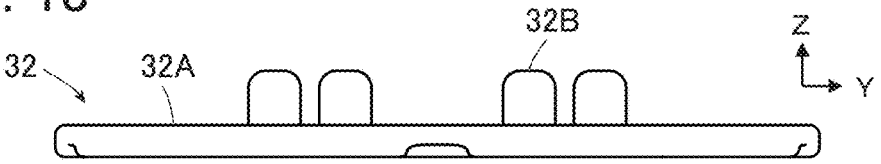
FIG. 18 is a side view showing the first insulator used in the connector according to Embodiment 2.

As illustrated in FIG. 18, the projections 32B of the first insulator 32 each have a substantially columnar shape projecting in the +Z direction as with the projections 12B of the first insulator 12 in the connector 11 according to Embodiment 1.

As with the connector 11 in Embodiment 1, the connector 31 can be connected to the plurality of flexible conductor 22, and each of the plurality of projections 32B of the first insulator 32 is inserted into the projection accommodating portion 13C of the corresponding contact 13 together with the corresponding flexible conductor 22.

In addition, the plurality of bosses 14C of the second insulator 14 are separately accommodated in the plurality of boss accommodating holes 32C of the first insulator 32 to fix the second insulator 14 and the first insulator 32 to each other.

Figure 19:
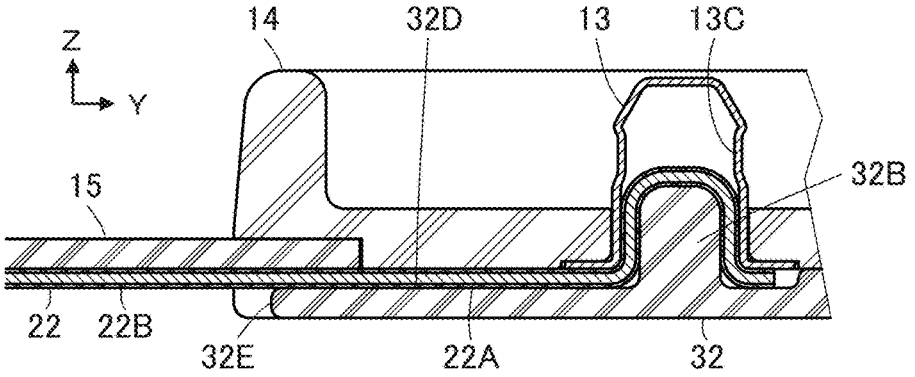
FIG. 19 is a partial cross-sectional view showing the connector according to Embodiment 2.

When the projection 32B of the first insulator 32 is inserted into the projection accommodating portion 13C of the contact 13 together with the flexible conductor 22, as illustrated in FIG. 19, the flexible conductor 22 is sandwiched between a lateral surface of the projection 32B and an inner surface of the projection accommodating portion 13C of the contact 13, and the flexible conductor 22 contacts the inner surface of the projection accommodating portion 13C, whereby the contact 13 is electrically connected to the flexible conductor 22.

At this time, an internal conductive portion 22A of each of the flexible conductors 22 is sandwiched between the first insulator 32 and the second insulator 14 and is electrically connected to the contact 13, and an external conductive portion 22B thereof extends to the outside of the first insulator 32 and the second insulator 14.

Figure 20:
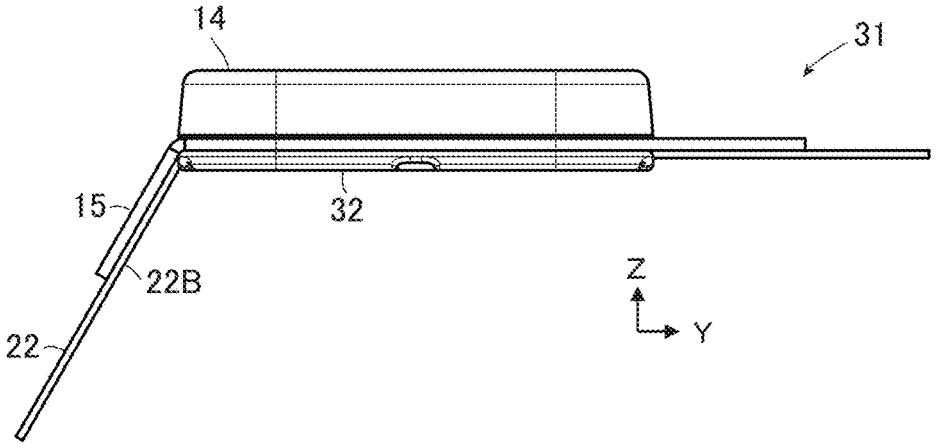
FIG. 20 is a side view showing the connector according to Embodiment 2 in a state where a sheet-like member is bent at an edge of the first insulator together with a flexible conductor.

For example, as illustrated in FIG. 20, the sheet-like member 15 and the external conductive portion 22B of the flexible conductor 22, both of which extend to the outside of the first insulator 32 and the second insulator 14, may be bent at the edges of the first insulator 32 and the second insulator 14 which have rigidity.

Figure 21:
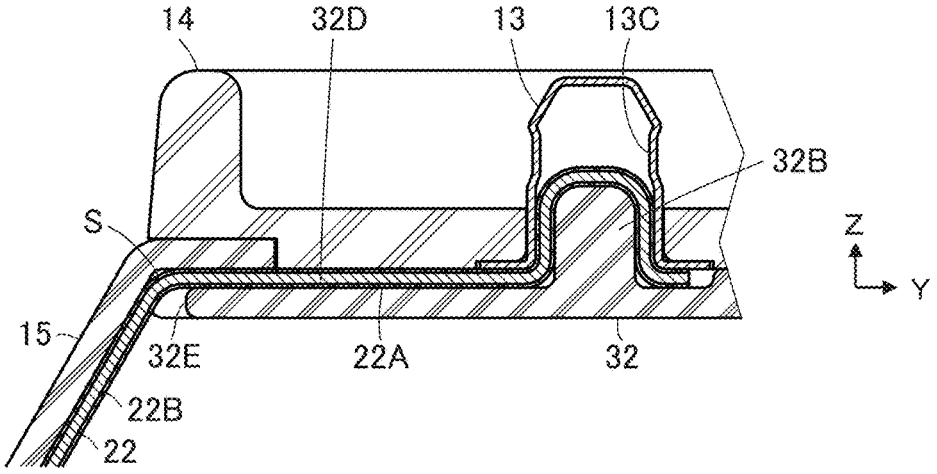
FIG. 21 is a partial cross-sectional view showing the connector of Embodiment 2 in the state illustrated in FIG. 20.

However, as illustrated in FIG. 21, the presence of the cutout 32E of the first insulator 32 allows a part of the external conductive portion 22B adjacent to the internal conductive portion 22A of the flexible conductor 22 to be accommodated in the cutout 32E connected to the opening end portion of the conductor accommodating groove 32D of the first insulator 32, whereby the flexible conductor 22 is allowed to extend in the −Z direction along the sheet-like member 15 while being gently curved with a relatively large radius of curvature without sharply bending at the opening end portion of the conductor accommodating groove 32D.

As a result, a gap S is formed between the bending portion of the sheet-like member 15 and the external conductive portion 22B of the flexible conductor 22 that is gently curved.

Thus, as with the connector 11 of Embodiment 1, concentration of bending stress acting on the flexible conductor is relaxed, whereby disconnection of the flexible conductor can be prevented even when the connector 32 is used while remaining attached to a garment for a long time.

In order for the flexible conductor 22 to be gently curved at the cutout 32E of the first insulator 32, the Y directional length L2 of the cutout 32E is preferably longer than, for example, the diameter dimension of the flexible conductor 22.

While the conductor accommodating groove 32D and the cutout 32E of the first insulator 32 have the width W2 slightly wider than the diameter dimension of the flexible conductor 22 in the X direction, the invention is not limited thereto, and they may have a width equal to the diameter dimension of the flexible conductor 22.

Embodiment 3

In Embodiments 1 and 2, the flexible conductor 21, 22 having conductivity is not held by, for example, an insulating substrate body but is independently sandwiched between the first insulator 12, 32 and the second insulator 14. However, the invention is not limited thereto.

Figure 22:
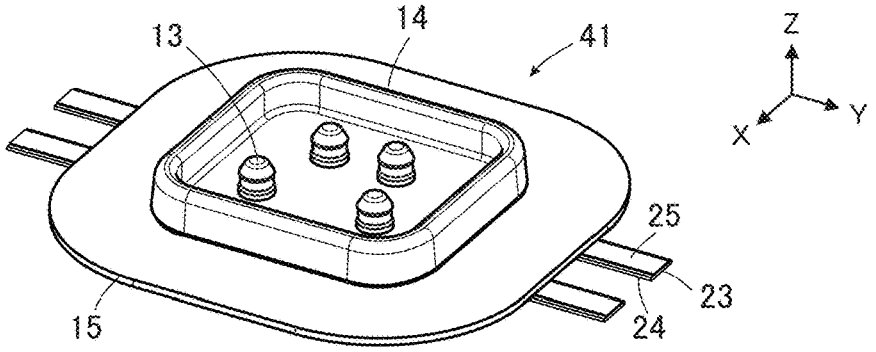
FIG. 22 is a perspective view showing a connector according to Embodiment 3 when viewed from an obliquely upper position.
Figure 23:
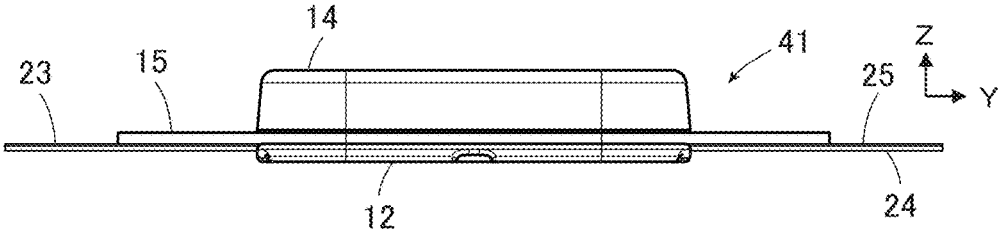
FIG. 23 is a side view showing the connector according to Embodiment 3.

FIGS. 22 and 23 illustrate a connector 41 according to Embodiment 3. The connector 41 is a connector connected to a plurality of flexible tapes 23. The connector 41 has the same configuration as the connector 11 according to Embodiment 1.

The flexible tape 23 has a flexible conductor 25 disposed to be exposed on a front surface of a sheet-like flexible substrate 24 made of an insulating material such as resin, and has a strip shape as with the flexible conductor 21 according to Embodiment 1, while the flexible substrate 24 has a width same as that of the flexible conductor 21 according to Embodiment 1.

As with the connector 11 according to Embodiment 1, the connector 41 can be connected to the plurality of flexible tapes 23, and each of the plurality of projections 12B of the first insulator 12 is inserted into the projection accommodating portion 13C of the corresponding contact 13 together with the corresponding flexible tape 23.

When the projection 12B of the first insulator 12 is inserted into the projection accommodating portion 13C of the contact 13 together with the flexible tape 23, the flexible tape 23 is sandwiched between a lateral surface of the projection 12B and an inner surface of the projection accommodating portion 13C of the contact 13, and the flexible conductor 25 of the flexible tape 23 contacts the inner surface of the projection accommodating portion 13C, whereby the contact 13 is electrically connected to the flexible conductor 25.

Figure 24:
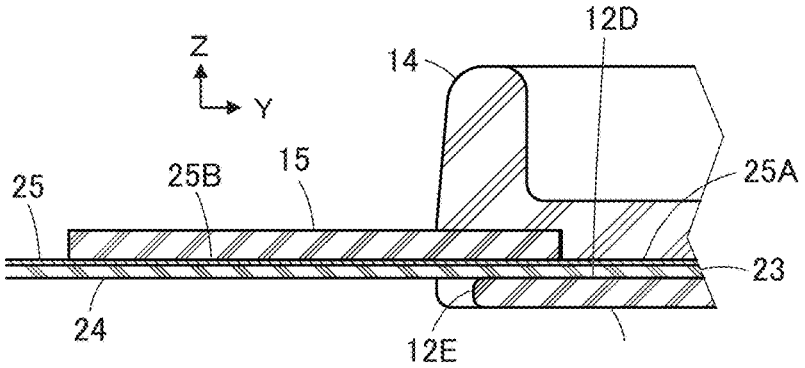
FIG. 24 is a partial cross-sectional view showing the connector according to Embodiment 3.

At this time, as illustrated in FIG. 24, an internal conductive portion 25A of each of the flexible conductors 25 is sandwiched between the first insulator 12 and the second insulator 14, and an external conductive portion 25B extends to the outside of the first insulator 12 and the second insulator 14.

Figure 25:
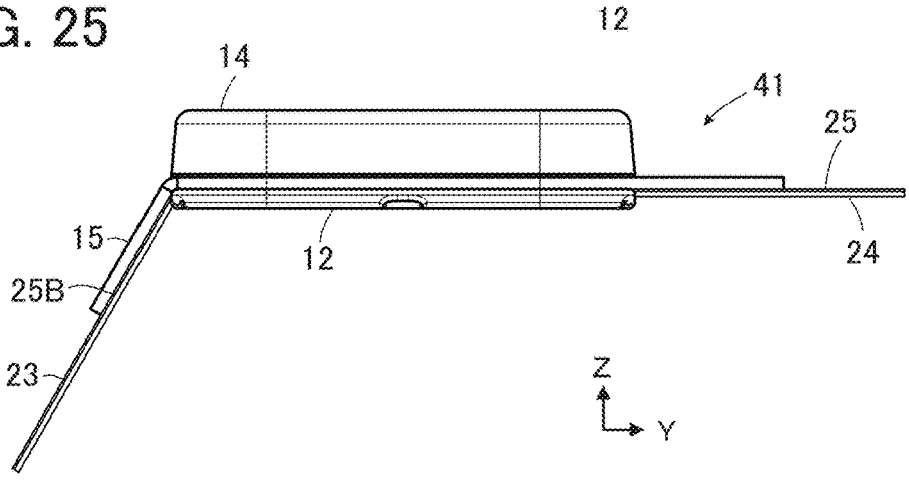
FIG. 25 is a side view showing the connector according to Embodiment 3 in a state where a sheet-like member is bent at an edge of the first insulator together with a flexible conductor.

For example, as illustrated in FIG. 25, the sheet-like member 15 and the flexible tape 23, both of which extend to the outside of the first insulator 12 and the second insulator 14, may be bent at the edges of the first insulator 12 and the second insulator 14 which have rigidity.

Figure 26:
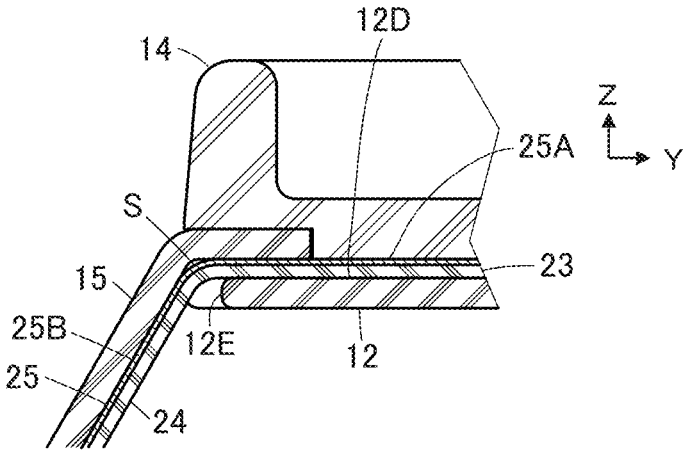
FIG. 26 is a partial cross-sectional view showing the connector of Embodiment 3 in the state illustrated in FIG. 25.
Figure 27:
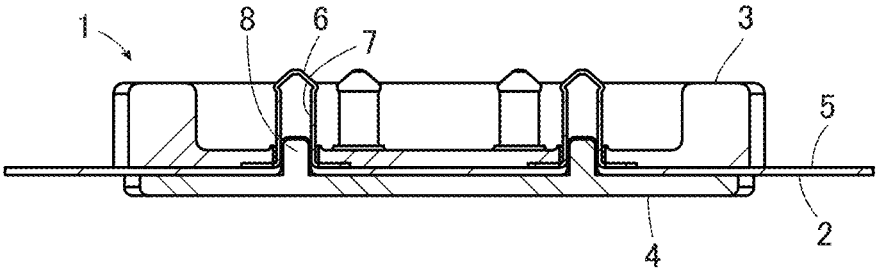
FIG. 27 PRIOR ART
FIG. 27 is a cross-sectional view showing a conventional connector.

However, as illustrated in FIG. 26, the presence of the cutout 12E of the first insulator 12 allows a part of the external conductor portion 25B adjacent to the internal conductive portion 25A of the flexible conductor 25 to enter the cutout 12E connected to the opening end portion of the conductor accommodating groove 12D of the first insulator 12 together with the flexible substrate 24, whereby the flexible conductor 25 is allowed to extend in the −Z direction along the sheet-like member 15 while being gently curved with a relatively large radius of curvature without sharply bending at the opening end portion of the conductor accommodating groove 12D.

As a result, a gap S is formed between the bending portion of the sheet-like member 15 and the flexible tape 23 that is gently curved.

Thus, as with the connector 11 according to Embodiment 1 and the connector 31 according to Embodiment 2, concentration of bending stress acting on the flexible conductor 25 is relaxed, whereby disconnection of the flexible conductor 25 of the flexible tape 23 can be prevented even when the connector 41 is used while remaining attached to a garment for a long time.

Similarly, instead of the flexible tape 23, the connector can be connected to a cloth with an electrode in which a flexible conductor is formed on a surface of the cloth such as fabric or textile by printing method. Also in this case, concentration of bending stress acting on the flexible conductor is relaxed, whereby disconnection of the flexible conductor of the cloth with the electrode can be prevented.

While in Embodiments 1 to 3, the sheet-like member 15 constitutes a connector fixing member for attaching the connector 11 to a garment (not shown), and the connector 11, 31, 41 is attached to the garment by fixing the sheet-like member 15 to cloth of the garment, the invention is not limited thereto, and the cloth of the garment can be used as the sheet-like member as it is.

While the plug-type contacts 13 are used in the above-described Embodiments 1 to 3, the invention is not limited thereto, and it is also possible to similarly configure a connector in which receptacle-type contacts are connected to the flexible conductors 21, 22, 25.

What is claimed is:

1. A connector to be connected to a flexible conductor, the connector comprising:

a first insulator;

a second insulator disposed to face the first insulator; and a contact made of a conductive material and connected to the flexible conductor, wherein the flexible conductor includes an internal conductive portion that is sandwiched between the first insulator and the second insulator and is electrically connected to the contact, and an external conductive portion that extends to an outside of the first insulator and the second insulator, wherein a sheet-like member extending at least from a circumferential edge of the first insulator and a circumferential edge of the second insulator to the outside of the first insulator and the second insulator is sandwiched between the circumferential edge of the first insulator and the circumferential edge of the second insulator while overlapping the flexible conductor, whereby the connector is attached to the sheet-like member, wherein of the first insulator and the second insulator, the first insulator positioned on a side of the flexible conductor in a position where the sheet-like member and the flexible conductor overlap each other has a cutout formed to correspond to the flexible conductor, and wherein when the sheet-like member is bent at an edge of the first insulator together with the flexible conductor, a part of the external conductive portion adjacent to the internal conductive portion of the flexible conductor enters the cutout.

2. The connector according to claim 1, wherein the first insulator has a conductor accommodating groove connected to the cutout and accommodating the internal conductive portion of the flexible conductor.

3. The connector according to claim 1, wherein the second insulator has a step portion formed at the circumferential edge of the second insulator and accommodating a part of the sheet-like member.

4. The connector according to claim 1, wherein the cutout has a width slightly wider than that of the flexible conductor.

5. The connector according to claim 1, wherein the sheet-like member comprises a connector fixing member made of an insulating material, and wherein the connector is attached to a garment by fixing the connector fixing member to cloth of the garment.

6. The connector according to claim 1, wherein the sheet-like member is constituted of cloth of a garment.

7. The connector according to claim 1, wherein the first insulator includes a projection, wherein the contact includes a projection accommodating portion of a recess shape into which the projection is inserted, and wherein when the projection is inserted into the projection accommodating portion of the contact together with the flexible conductor, the flexible conductor is sandwiched between a lateral surface of the projection and an inner surface of the projection accommodating portion to contact the inner surface of the projection accommodating portion, whereby the contact is electrically connected to the flexible conductor.

8. The connector according to claim 7, wherein the contact has a tubular portion and a flange formed at one end of the tubular portion, wherein the second insulator includes a contact through-hole that is penetrated by the tubular portion of the contact and is smaller than the flange, and wherein when the second insulator is fixed to the first insulator such that the tubular portion of the contact passes through the contact through-hole and the flange is pressed against the first insulator, the contact is fixed to the first insulator and the second insulator.

9. The connector according to claim 8, wherein the second insulator has a plurality of bosses projecting toward the first insulator, wherein the first insulator has a plurality of boss accommodating holes for accommodating the plurality of bosses, and wherein the plurality of bosses are separately accommodated in the plurality of boss accommodating portions to fix the second insulator to the first insulator.

10. The connector according to claim 7, wherein the second insulator has a counter connector accommodating portion for accommodating a part of a counter connector.

11. The connector according to claim 1, wherein the flexible conductor is independently sandwiched between the first insulator and the second insulator.

12. The connector according to claim 1, wherein the flexible conductor is disposed to be exposed on a front surface of a substrate body, and wherein the flexible conductor is sandwiched between the first insulator and the second insulator such that a rear surface of the substrate body faces the first insulator and the flexible conductor faces the second insulator.

13. The connector according to claim 1, wherein the contact is a plug-type contact.

* * * * *